United States Patent [19]

Barley et al.

[11] 4,303,899

[45] Dec. 1, 1981

[54] MATCHED HIGH Q, HIGH FREQUENCY RESONATORS

[75] Inventors: Thomas A. Barley; Gustaf J. Rast, Jr., both of Huntsville, Ala.; James R. Ashley, Boulder, Colo.

[73] Assignee: The United States of America as represented by the Secretary of the Army, Washington, D.C.

[21] Appl. No.: 146,804

[22] Filed: May 5, 1980

[51] Int. Cl.[3] ..... H01P 7/04

[52] U.S. Cl. ..... 333/225; 333/33; 333/235; 333/263

[58] Field of Search ..... 331/101, 102; 333/207, 333/209, 221, 222, 224, 225, 232, 233, 235, 253, 263

[56] References Cited

U.S. PATENT DOCUMENTS 2,605,356 7/1952 Ragan ..... 333/253 X

*Primary Examiner*—Paul L. Gensler

*Attorney, Agent, or Firm*—Nathan Edelberg; Robert P. Gibson; Robert C. Sims

[57] ABSTRACT

The resonator is formed with a primary line which is slightly less than a multiple of a half wavelength long, a tee, and a matching stub. The primary line and the stub are adjustable to make the total length a multiple of one half wavelength. A mechanical link can be connected across the two adjustable lengths so as to maintain a total length of a multiple integral of one half wavelength.

4 Claims, 3 Drawing Figures

MATCHED HIGH Q, HIGH FREQUENCY RESONATORS

BACKGROUND OF THE INVENTION

Discriminators for f.m. noise measurements require high Q resonators. This need was partially circumvented by the transmission line discriminators of U.S. Pat. No. 4,002,970 and 4,002,971. U.S. Pat. No. 3,675,124 which taught the use of cavity resonators indicates the desired properties for a resonator used in a disciminator. It must have high Q; and it must be matched to the transmission line at resonance. The disciminator element of U.S. Pat. No. 4,002,970 cannot be operated as a cavity because of the electrical shortcomings of the slide screw tuner. As the transmission line is made shorter and the loss reduced, more insertion of the tuner screw is required. Since this tuner can produce only a VSWR of about 20, it will not serve to match a short transmission line to give an optimum cavity Q.

DESCRIPTION OF THE PREFERRED EMBODIMENT

Figure 1:
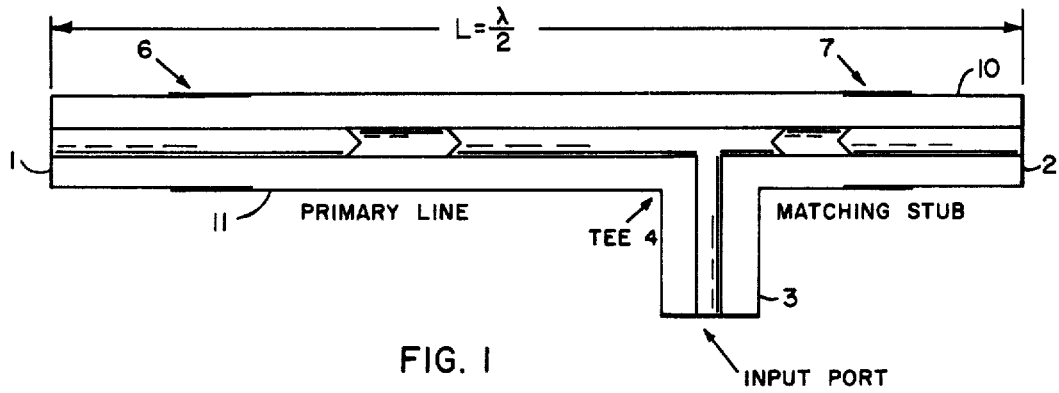
FIG. 1 is a diagrammatic showing of a basic embodiment of the present invention.

FIG. 1 shows the conceptually simplest embodiment of our invention. Essentially, a transmission line one half wavelength long ($L=\lambda/2$) is shorted at each end 1 and 2. A coupling port 3 to this resonator is provided by a tee 4. Coaxial transmission line components are shown; however, any kind of transmission line (parallel wires, waveguides, etc.,) could in principle be used. Essentially, choosing the position of the tee within the resonator by adjusting sliding joints 6 and 7 determines the matching to the transmission line at the input port.

The theory of this resonator can be illustrated by a Smith Chart (not shown). As we move away from a short (clockwise), the admittance locus is a circle (the rim of the Smith Chart) for zero losses. For small losses, the locus will be a spiral. At some point this locus intersects the $G=1$ line of the chart; for example, at (normalized) 1-j6. If a (normalized) inductive susceptance of j6 were connected in parallel (with the tee) at this point, the resultant admittance would be $1.0+j0$; that is, a perfect match. This inductive susceptance of j6 can be obtained with a short matching stub 10. The length of this stub is determined from another application of the Smith Chart. Note that the length of this stub plus the length of the primary arm 11 is obviously very close to one half wavelength, the distance equivalent to one complete trip around the Smith Chart. Thus, the adjustment of resonance frequency and of the matching condition are obtained with the two sliding joints 6 and 7. The adjustments do interact.

Figure 2:
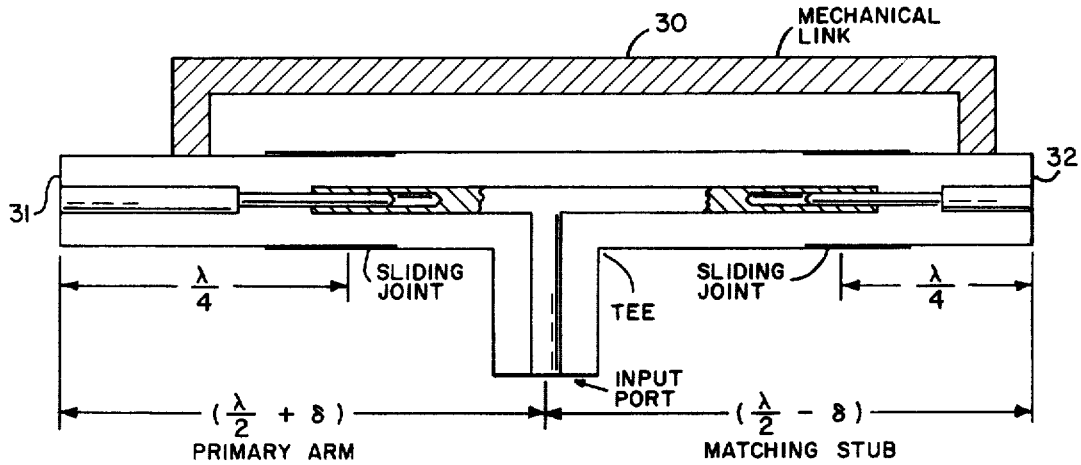
FIG. 2 is diagrammatic showing of a further embodiment of the present invention.

This interaction and the fact that the sliding joint for the matching stub must be at a relatively high current point in the resonator makes this resonator difficult to adjust. FIG. 2 shows a second embodiment which alleviates this trouble. The primary arm is now made longer that a half wavelength by a distance $\delta$. The matching stub length is less than a half wavelength by the same distance giving a perfect match at resonance. As shown the resonator length is one wavelength. By reducing the loss in the sliding joints, the resulting cavity Q is increased.

Essentially, the adjustment of resonance frequency is by the total length of the line and the adjustment of matching is by the distance $\delta$. We disclose the ideal of a mechanical link 30, as shown in FIG. 2, to hold the length (resonance frequency) constant while adjusting the distance to obtain the match at resonance. This effectively separates the interaction of the adjustments of resonance frequency and match.

The additional length of the matching stub makes it possible to position each of the sliding joints 31 and 32 about one quarter wavelength from the shorts. This minimizes erratic tuning caused by fluctuation of joint resistance as the line lengths are changed in tuning.

As can be seen from FIGS. 1 and 2 the primary side and the matching stubs side each consist of two sliding joints. The center conductor forming the part of tee is hollowed out at each end so as to mate with the adjustable portions and to maintain electrical contact.

Figure 3:
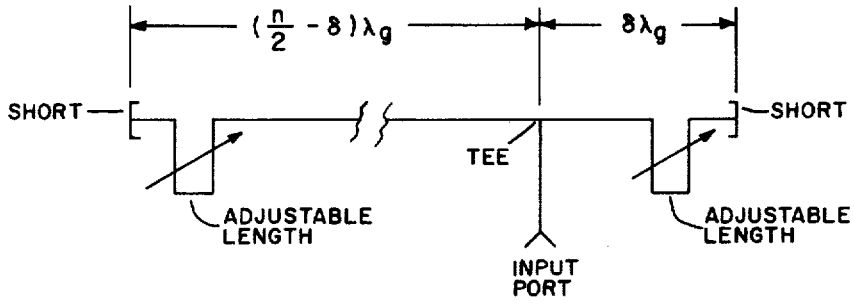
FIG. 3 is a schematic representation of the present invention.

The invention of this disclosure can be generalized by using a transmission line n wavelengths long as shown in FIG. 3. Here, n can be any integer equal to or greater than 1. The particular lengths shown are for example only.

Construction of high Q resonators from readily available coaxial transmission line components is disclosed. These resonators can be constructed for frequencies from the hf to shf-regions. It is easily possible to make these resonators appear as matched, that is with a very low reflection coefficient at the resonant frequency. Such a matched, high Q resonator is useful as a discriminating element for f.m. noise measuring discriminators.

These new resonators have been used with several different types of discriminator circuits to obtain approximately 3 db increase in f.m. detection sensitivity as compared to a mathematically optimum length transmission line. The increased sensitivity is accomplished with less than 1/5 the length of transmission line that would be required for a mathematically optimum length line. Within the limitations of practical, useable transmission line lengths, these resonators can be built at frequencies ranging from about 1 megahertz to beyond several gigahertz.

We claim:

1. A high-frequency resonator comprising a tee connection having first and second arms extended from an in/out port; first and second sliding joints on the ends of said first and second arms respectively; third and fourth arms having one end connected to said first and second sliding joints respectively; the other ends of said third and fourth arms being connected to electrical short circuits; and said third and fourth arms being moveably mounted on said sliding joints so as to vary the length of said arms.

2. A resonator as set forth in claim 1 wherein said arms are made up of transmission line components.

3. A resonator as set forth in claim 2 further comprising a mechanical linking device connected to said third and fourth arms so as to maintain a predetermined distance between said short circuits.

4. A resonator as set forth in claim 3 wherein said predetermined distance is a multiple of a half wavelength of a frequency in which said resonator is to resonate.

* * * * *